US011839259B2

(12) United States Patent
Matthews et al.

(10) Patent No.: US 11,839,259 B2
(45) Date of Patent: Dec. 12, 2023

(54) ARTICLES OF FOOTWEAR AND SOLE STRUCTURES WITH PRESSURE-MAPPED MIDSOLE TOPOGRAPHIES AND INLAID OUTSOLES

(71) Applicant: NIKE, Inc., Beaverton, OR (US)

(72) Inventors: Darryl Matthews, Portland, OR (US); Dov Michael Lashmore, Milwaukie, OR (US); Can Eldem, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 22 days.

(21) Appl. No.: 17/746,223

(22) Filed: May 17, 2022

(65) Prior Publication Data

US 2022/0273072 A1 Sep. 1, 2022

Related U.S. Application Data

(63) Continuation of application No. 16/996,345, filed on Aug. 18, 2020, now Pat. No. 11,357,285, which is a (Continued)

(51) Int. Cl.

| | |
|---|---|
| ***A43B 13/22*** | (2006.01) |
| ***A43B 13/12*** | (2006.01) |
| ***A43B 13/04*** | (2006.01) |
| ***A43B 7/32*** | (2006.01) |
| ***A43D 1/02*** | (2006.01) |

(Continued)

(52) U.S. Cl.

CPC ..... *A43B 13/125* (2013.01); *A43B 5/00* (2013.01); *A43B 7/32* (2013.01); *A43B 13/04* (2013.01); *A43B 13/122* (2013.01); *A43B 13/22* (2013.01); *A43B 13/223* (2013.01); *A43B 13/24* (2013.01);

(Continued)

(58) Field of Classification Search

CPC ..... A43B 13/22; A43B 13/223; A43B 13/24; A43B 13/26; A43B 13/125; A43B 13/122

See application file for complete search history.

(56) References Cited

U.S. PATENT DOCUMENTS 4,160,331 A * 7/1979 Bell ..... A43B 3/16 36/59 B 4,262,434 A * 4/1981 Michelotti ..... A43B 13/36 36/129

(Continued)

*Primary Examiner* — Ted Kavanaugh

(74) *Attorney, Agent, or Firm* — Quinn IP Law

(57) ABSTRACT

Presented are footwear sole structures with pressure-mapped midsole topographies and inlaid wear-mitigating outsoles, methods for making/using such sole structures, and footwear fabricated with such sole structures. An article of footwear includes an upper for receiving and attaching to a foot of a user, and a sole structure attached to the upper for supporting thereon the user's foot. The sole structure includes a midsole that is formed with a first material having a first hardness, and an outsole that is mounted to the midsole and formed with a second material that is harder than the first material. The midsole has a ground-facing surface with multiple cavities, multiple channels interspersed with the cavities, and ground-contacting land segments that separate the cavities from the channels. The outsole is disposed in the channels and positioned between the cavities such that a ground-contacting outsole surface is substantially flush with the midsole's ground-contacting land segments.

20 Claims, 4 Drawing Sheets

Related U.S. Application Data continuation of application No. 16/193,544, filed on Nov. 16, 2018, now Pat. No. 10,874,167.

(51) Int. Cl.

| | |
|---|---|
| ***A43B 5/00*** | (2022.01) |
| ***A43B 13/26*** | (2006.01) |
| ***A43C 15/16*** | (2006.01) |
| ***A43B 13/24*** | (2006.01) |

(52) U.S. Cl.

CPC ..... *A43B 13/26* (2013.01); *A43C 15/161* (2013.01); *A43D 1/02* (2013.01)

(56) References Cited

U.S. PATENT DOCUMENTS 4,380,878 A * 4/1983 Skaja ..... A43B 5/06 36/129
4,564,966 A * 1/1986 Chen ..... A43B 13/04 36/31
4,747,220 A * 5/1988 Autry ..... A43B 13/26 36/114
4,899,467 A * 2/1990 Mackey ..... A43B 13/223 36/31
6,237,249 B1 * 5/2001 Aguerre ..... A43B 3/122 36/11.5
7,124,519 B2 * 10/2006 Issler ..... A43B 13/16 36/31
7,249,428 B1 * 7/2007 Burella ..... A43B 13/189 36/59 A
D615,740 S * 5/2010 Banik ..... D2/951
9,049,900 B1 * 6/2015 Cox ..... A43B 1/0027
10,874,167 B2 * 12/2020 Matthews ..... A43B 13/122
2002/0184793 A1 * 12/2002 Sato ..... A43B 13/12 36/114
2004/0020080 A1 * 2/2004 Cox ..... A43B 13/24 36/103
2004/0098881 A1 * 5/2004 Flavio ..... A43B 13/41 36/31
2007/0113427 A1 * 5/2007 Mansfield ..... A43B 5/00 36/89
2012/0023781 A1 * 2/2012 Dojan ..... A43B 13/122 36/103

* cited by examiner

ARTICLES OF FOOTWEAR AND SOLE STRUCTURES WITH PRESSURE-MAPPED MIDSOLE TOPOGRAPHIES AND INLAID OUTSOLES

CLAIM OF PRIORITY AND CROSS-REFERENCE TO RELATED APPLICATIONS

This application is a continuation of U.S. patent application Ser. No. 16/996,345, which was filed on Aug. 18, 2020, is now allowed, and is a continuation of U.S. patent application Ser. No. 16/193,544, which was filed on Nov. 16, 2018, and is now U.S. Pat. No. 10,874,167 B2, both of which are incorporated herein by reference in their respective entireties and for all purposes.

TECHNICAL FIELD

The present disclosure relates generally to articles of footwear. More specifically, aspects of this disclosure relate to footwear with multilayered sole structures having impact-attenuating midsoles and wear-mitigating outsoles.

BACKGROUND

Articles of footwear, such as shoes, boots, slippers, sandals, and the like, are generally composed of two primary elements: an upper for securing the footwear to a user's foot; and a sole for providing subjacent support to the foot. Uppers may be fabricated from a variety of materials, including textiles, foams, polymers, natural and synthetic leathers, etc., that are stitched or bonded together to form a shell or harness for securely receiving a foot. Many sandals and slippers have an upper with an open toe or heel construction, with some designs incorporating an upper that is limited to a series of straps extending over the instep and, optionally, around the ankle. Conversely, boot and shoe designs employ a full upper with a closed toe and heel construction that encases the foot. An ankle opening through a rear quarter portion of the footwear provides access to the footwear's interior, facilitating entry and removal of the foot into and from the upper. A shoelace or strap may be utilized to secure the foot within the upper.

A sole structure is generally attached to the underside of the upper, positioned between the user's foot and the ground. In many articles of footwear, including athletic shoes and boots, the sole structure is a layered construction that generally incorporates a comfort-enhancing insole, an impact-mitigating midsole, and a surface-contacting outsole. The insole, which may be located partially or entirely within the upper, is a thin and compressible member that provides a contact surface for the underside "plantar" region of the user's foot. By comparison, the midsole is mounted underneath the insole, forming a middle layer of the sole structure. In addition to attenuating ground reaction forces, the midsole may help to control foot motion and impart stability. Secured underneath the midsole is an outsole that forms the ground-contacting portion of the footwear. The outsole is usually fashioned from a durable, waterproof material that includes features for improving traction.

SUMMARY

Presented herein are footwear sole structures with pressure-mapped midsole topographies inlaid with wear-mitigating outsoles, methods for making and methods for using such sole structures, and articles of footwear fabricated with such sole structures. By way of example, and not limitation, an athletic shoe is disclosed that includes a multilayered sole structure with a synthetic-rubber outsole that is inlaid into a polymer foam-based midsole with a pressure-mapped topography. The midsole topography is molded with an engineered pattern of channels and cavities, the shapes, depths, locations, orientations, and mean densities of which are designed to coincide with pressure zones identified through sensor-generated pressure map data. Computational design filters are used to optimize the midsole topography in order to increase ground-reaction-force attenuation while providing increased energy return and minimized overall weight. The allocation and shape of the outsole are established through an algorithmic pattern-matching technique to structurally reinforce key sections of the footwear's ground-engaging surface without unduly increasing gross shoe weight. Pockets in the midsole's sidewall and base are filled with rubber push fasteners (or "pods") that secure the outsole to the midsole while concomitantly increasing foot support and sole grip at key locations identified as optimal through pressure map data. The midsole, which may be molded as a single-piece structure, and the outsole, which may be molded is a bipartite structure, may be joined through a combination of debossing, adhesives, and push fasteners.

Attendant benefits for at least some of the disclosed concepts include a minimalist outsole construction that extends the operational life of the midsole and, thus, the footwear without compromising shoe integrity or significantly increasing gross shoe weight. Other attendant benefits may include a midsole with a ground-facing topography that increases foam density at key areas of the foot's plantar region, while minimizing foam density at non-critical locations to optimize attenuation of ground impact forces while concurrently minimizing gross shoe weight. The midsole foam composition may absorb about 30% or less of compression forces imparted by the user (EVA foams average 40-60% force absorption) to provide a softer feel with 15-20% more energy return compared to comparable foam sole structures. Rubber pods spaced along the underside and perimeter of the sole help to reduce forces caused by the shoe's impact with the ground. The overall design helps to enhance underfoot comfort for a variety of discrete maneuvers, including standing, shifting, walking, and running.

Aspects of this disclosure are directed to multilayered footwear sole structures with polymer foam midsoles formed with a pressure-mapped topography and inlaid with wear-mitigating, synthetic rubber outsoles. In an example, a sole structure for an article of footwear includes a midsole formed with a first material having a first hardness, and an outsole formed with a second material having a second hardness that is greater than the midsole's first hardness. The midsole is formed with a ground-facing surface having a plurality of cavities, a plurality of channels interspersed with the cavities, and ground-contacting land segments separating the cavities from the channels. The outsole is mounted to the underside of the midsole, positioned between the midsole's recessed cavities. The outsole is disposed in and substantially fills the midsole channels such that a ground-contacting outsole surface is substantially flush with the ground-contacting land segments of the midsole.

Other aspects of this disclosure are directed to footwear fabricated with any of the disclosed multilayered sole structures. As an example, an article of footwear includes an upper that receives and attaches to a foot of a user, and a sole structure that is attached to the upper to support thereon the user's foot. The sole structure includes a midsole that is formed with a first material having a first hardness and has a ground-facing surface with multiple cavities, multiple channels interspersed with the cavities, and ground-contacting land segments that separate the cavities and channels. The sole structure also includes an outsole that is mounted to the midsole and is formed with a second material having a second hardness greater than the midsole's first hardness. The outsole is disposed in the channels and positioned between the cavities such that a ground-contacting outsole surface is substantially flush with the ground-contacting land segments of the midsole. An optional insole—colloquially known as a "sock liner"—may be disposed inside the upper and seated on top of the midsole.

Additional aspects of this disclosure are directed to methods for manufacturing and methods for using any of the disclosed footwear and/or sole structures. In an example, a method is presented for manufacturing a sole structure for an article of footwear. This representative method includes, in any order and in any combination with any of the above or below disclosed features and options: forming, e.g., via compression or injection molding using a first material having a first hardness, a midsole having a ground-facing surface with multiple discrete cavities, multiple discrete channels interspersed with the cavities, and multiple discrete ground-contacting land segments separating the cavities from the channels; forming, via compression or injection molding using a second material having a second hardness greater than the first hardness, an outsole having a ground-contacting outsole surface; and mounting the outsole to the midsole with the outsole disposed in the midsole channels and positioned between the cavities such that the ground-contacting outsole surface is substantially flush with the ground-contacting land segments of the midsole.

For any of the disclosed sole structures, footwear, and manufacturing methods, the midsole channels may include one or more continuous chains of mutually parallel channel segments interconnected by linking channel segments. The midsole has a longitudinal centerline that extends lengthwise through the sole structure's forefoot, midfoot and hindfoot regions, e.g., parallel to the sagittal plane and perpendicular to the corona plane of the body. The parallel channel segments and linking channel segments of the midsole may be obliquely angled with respect to the sole structure's longitudinal centerline. In this instance, two or more parallel channel segments may extend from a medial side of the sole structure, proximate a hallux ("big") toe region, to a lateral side of the sole structure, proximate a minimus ("little") toe region. Two or more of the linking channel segments may be interposed between and generally orthogonal to two or more of the parallel channel segments. Other linking channel segments may be obliquely angled with respect to their corresponding parallel channel segments. A discrete segment of the outsole may be isolated to the hindfoot region of the outsole and have a planar shape with an outer periphery that is primarily composed of circular arcs.

For any of the disclosed sole structures, footwear, and manufacturing methods, each of the midsole's parallel channel segments may have a distinct length and a distinct plan-view profile. Concomitantly, the outsole may have one or more continuous chains of mutually parallel segments with distinct lengths and distinct plan-view profiles. In a specific example, a discrete forefoot segment of the outsole may have at least four distinct parallel channel segments. For applications where the outsole substantially fills the midsole's channels, the profiles of the outsole's parallel segments will coincide with the profiles of the midsole's channel segments. In any instance, the plan-view profile of each parallel channel segment may have a respective width that varies along the respective length of that channel segment. Optionally, the midsole cavities may include two or more discrete, mutually parallel elongated cavities that are interleaved with and parallel to the parallel channel segments. The midsole topography may be formed with an assortment of discrete, distinctly shaped cavities each having a nontraditional shape.

For any of the disclosed sole structures, footwear, and manufacturing methods, the midsole's channels may include discrete forefoot and hindfoot channels that are located in the forefoot and hindfoot regions, respectively, of the midsole. In this instance, the outsole may include discrete forefoot and hindfoot outsole segments that are disposed in the forefoot and hindfoot channels, respectively, of the midsole. Optionally, the midsole's cavities may include one or more midfoot cavities located in the midfoot region of the midsole between the forefoot and hindfoot regions. The midfoot region of the midsole may be characterized by a lack of a ground-contacting outsole. As another option, the midsole cavities may also include discrete forefoot and hindfoot cavities that are located in the forefoot and hindfoot regions, respectively, of the midsole. These forefoot and hindfoot cavities are exposed through their corresponding forefoot and hindfoot outsole segments. At least one cavity may extend across at least a portion of the forefoot to midfoot regions, and at least one cavity may extend across at least a portion of the midfoot and hindfoot regions.

For any of the disclosed sole structures, footwear, and manufacturing methods, the midsole cavities may include multiple discrete, mutually parallel elongated cavities, each of which has a distinct length and a distinct plan-view profile. In this instance, each plan-view profile of each elongated cavity may have a respective width that varies along the respective length of that elongated cavity. Each elongated cavity may also have a distinct undulating base with a respective depth that varies along the length of that elongated cavity. As a further option the midsole may be molded as a single-piece structure from a polymer foam; conversely, the outsole may be molded as a bipartite structure from a synthetic rubber.

For any of the disclosed sole structures, footwear, and manufacturing methods, the midsole may include multiple recessed pockets; in this instance, a plurality of fasteners extends through the outsole and interference fits with the pockets of the midsole thereby mechanically coupling the outsole to the midsole. Each fastener may have a ground-contacting head portion that protrudes from the ground-contacting outsole surface. Each fastener may be integrally formed with a stem portion that connects a root portion with the head portion. The root portion substantially fills a respective pocket inside the midsole. The fasteners may include two or more mutually parallel rows of fasteners, each of which is aligned with and extends through a respective one of the mutually parallel channel segments of the midsole. As another option, the midsole may include a sidewall that defines the sole structure's outer perimeter. In this instance, the outsole may wrap around select segments of the midsole, extending across and covering portions of the midsole's ground-facing surface and portions of the sidewall. The sole structure may include sidewall fasteners that extend through wrapped around portions of the outsole and into holes in the sidewall. These sidewall fasteners may interference fit with pockets inside the midsole.

The above summary does not represent every embodiment or every aspect of the present disclosure. Rather, the foregoing summary merely provides an exemplification of some of the novel concepts and features set forth herein. The above features and advantages, and other features and attendant advantages of this disclosure, will be readily apparent from the following detailed description of illustrated examples and representative modes for carrying out the present disclosure when taken in connection with the accompanying drawings and the appended claims. Moreover, this disclosure expressly includes any and all combinations and subcombinations of the elements and features presented above and below.

Figure 1:
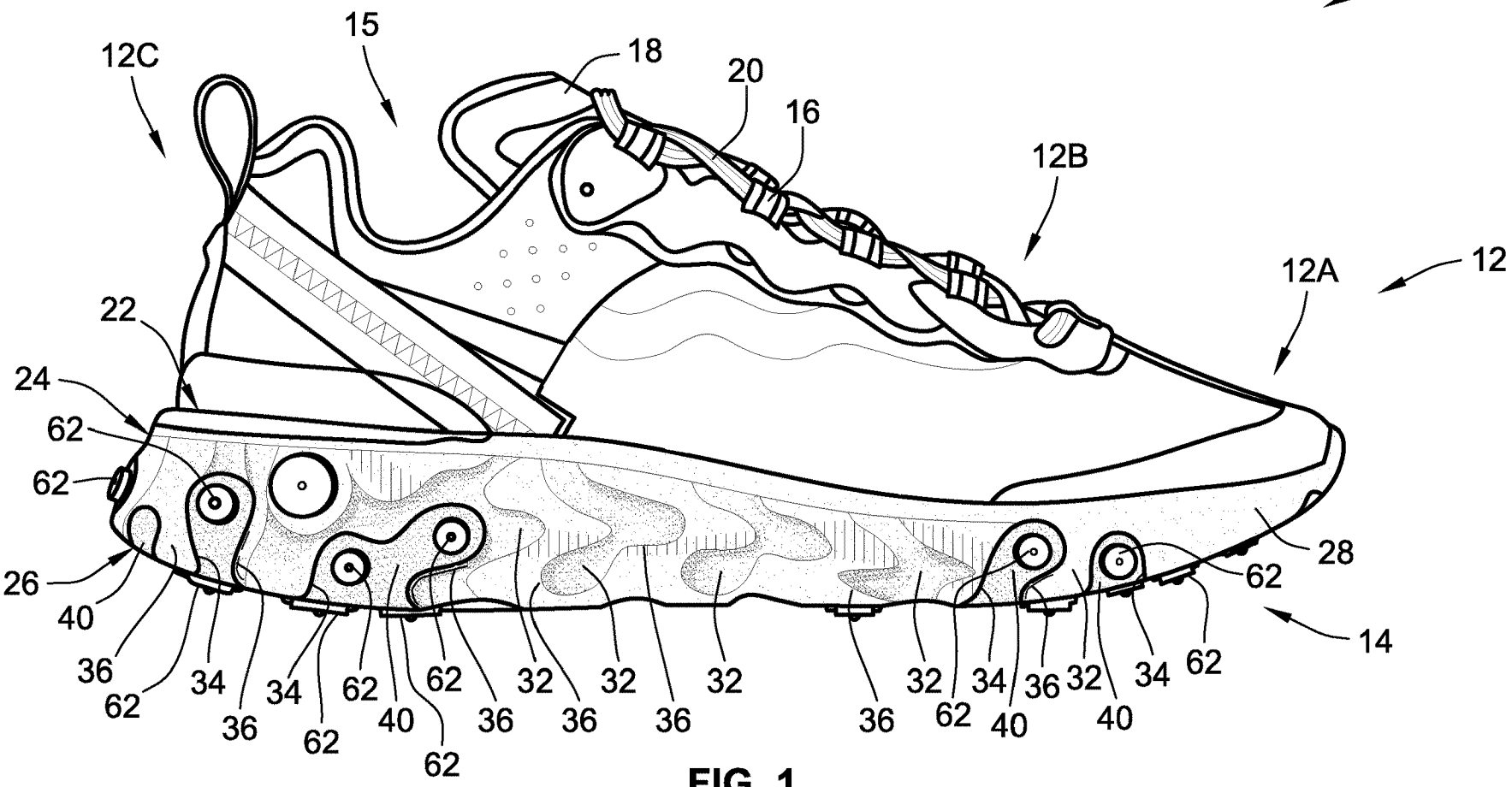
FIG. 1 is a lateral, side-view illustration of a representative article of footwear with a multilayered sole structure having a pressure-mapped midsole topography inlaid with a wear-mitigating outsole in accordance with aspects of the present disclosure.

The present disclosure is amenable to various modifications and alternative forms, and some representative embodiments are shown by way of example in the drawings and will be described in detail herein. It should be understood, however, that the novel aspects of this disclosure are not limited to the particular forms illustrated in the above-enumerated drawings. Rather, the disclosure is to cover all modifications, equivalents, combinations, subcombinations, permutations, groupings, and alternatives falling within the scope of this disclosure as encompassed by the appended claims.

DETAILED DESCRIPTION

This disclosure is susceptible of embodiment in many different forms. Representative examples of the disclosure are shown in the drawings and will be described in detail herein with the understanding that these representative examples are provided as an exemplification of the disclosed principles, not limitations of the broad aspects of the disclosure. To that extent, elements and limitations that are described in the Abstract, Technical Field, Background, Summary, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the words "any" and "all" shall both mean "any and all"; and the words "including," "comprising," "having," "containing," and the like shall each mean "including without limitation." Moreover, words of approximation, such as "about," "almost," "substantially," "approximately," and the like, may be used herein in the sense of "at, near, or nearly at," or "within 0-5% of," or "within acceptable manufacturing tolerances," or any logical combination thereof, for example. Lastly, directional adjectives and adverbs, such as fore, aft, medial, lateral, proximal, distal, vertical, horizontal, front, back, left, right, etc., may be with respect to an article of footwear when worn on a user's foot and operatively oriented with a ground-engaging portion of the sole structure seated on a flat surface, for example.

Referring now to the drawings, wherein like reference numbers refer to like features throughout the several views, there is shown in FIG. 1 a representative article of footwear, which is designated generally at 10 and portrayed herein for purposes of discussion as an athletic shoe or "sneaker." The illustrated article of footwear 10—also referred to herein as "footwear" or "shoe" for brevity—is merely an exemplary application with which novel aspects and features of this disclosure may be practiced. In the same vein, implementation of the present concepts for a trilayer sole structure with a single-piece polymer foam midsole and a bipartite synthetic-rubber outsole should also be appreciated as a representative implementation of the disclosed concepts. It will therefore be understood that aspects and features of this disclosure may be utilized for sole structures with different chemical makeups and different layer compositions, and may be incorporated into any logically relevant type of footwear. As used herein, the terms "shoe" and "footwear," including permutations thereof, may be used interchangeably and synonymously to reference any suitable type of garment worn on a human foot. Lastly, features presented in the drawings are not necessarily to scale and are provided purely for instructional purposes. Thus, the specific and relative dimensions shown in the drawings are not to be construed as limiting.

Figure 2:
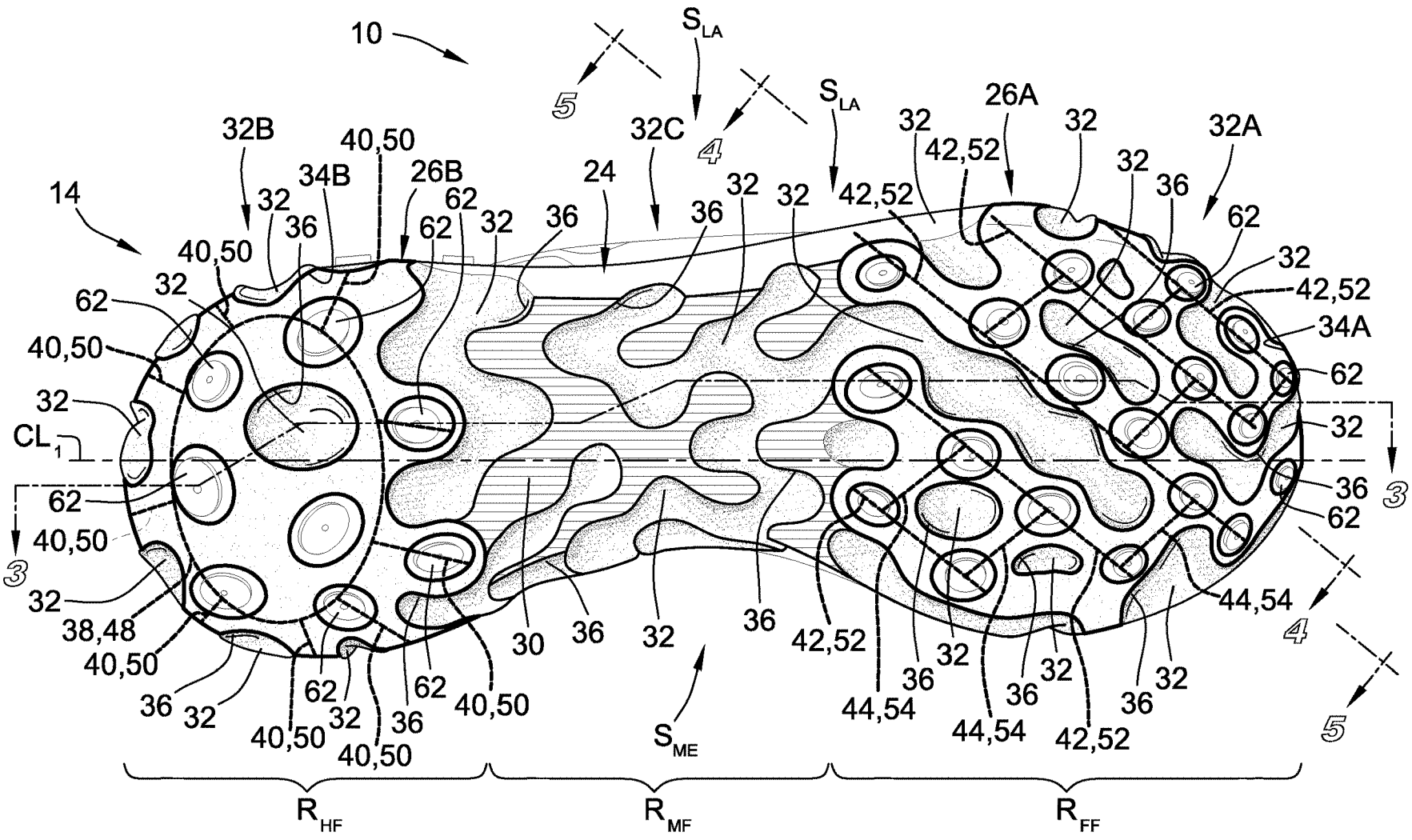
FIG. 2 is a bottom-view illustration of the representative article of footwear and multilayered sole structure of FIG. 1.

The representative article of footwear 10 is generally depicted in FIGS. 1 and 2 as a bipartite construction that is primarily composed of a foot-receiving upper 12 mounted on top of a subjacent sole structure 14. For ease of reference, footwear 10 may be divided into three anatomical regions: a forefoot region $R_{FF}$, a midfoot region $R_{MF}$, and a hindfoot (heel) region $R_{HF}$, as shown in FIG. 2. Footwear 10 may also be divided along a vertical plane into a lateral segment $S_{LA}$—a distal half of the shoe 10 farthest from the sagittal plane of the human body—and a medial segment $S_{ME}$—a proximal half of the shoe 10 closest to the sagittal plane of the human body. In accordance with recognized anatomical classification, the forefoot region $R_{FF}$ is located at the front of the footwear 10 and generally corresponds with the phalanges (toes), metatarsals, and any interconnecting joints thereof. Interposed between the forefoot and hindfoot regions $R_{FF}$ and $R_{HF}$ is the midfoot region $R_{MF}$, which generally corresponds with the cuneiform, navicular and cuboid bones (i.e., the arch area of the foot). Hindfoot region $R_{HF}$, in contrast, is located at the rear of the footwear 10 and generally corresponds with the talus and calcaneus bones. Both lateral and medial segments $S_{LA}$ and $S_{ME}$ of the footwear 10 extend through all three anatomical regions $R_{FF}$, $R_{MF}$, $R_{HF}$, and each corresponds to a respective transverse side of the footwear 10. While only a single shoe 10 for a right foot of a user is shown in FIGS. 1 and 2, a mirrored, substantially identical counterpart for a left foot of a user may be provided. Recognizably, the shape, size, material composition, and method of manufacture of the shoe 10 may be varied, singly or collectively, to accommodate practically any conventional or nonconventional footwear application.

With reference again to FIG. 1, the upper 12 is depicted as having a shell-like, closed toe and heel configuration for encasing a human foot. Upper 12 of FIG. 1 is generally defined by three adjoining sections, namely a toe box 12A, a vamp 12B and a rear quarter 12C. The toe box 12A is shown as a rounded forward tip of the upper 12 that extends from distal to proximal phalanges to cover and protect the user's toes. By comparison, the vamp 12B is an arched midsection of the upper 12 that is located aft of the toe box 12A and extends from the metatarsals to the cuboid. As shown, the vamp 12B also provides a series of lace eyelets 16 and a shoe tongue 18. Positioned aft of the vamp 12B is a rear quarter 12C that extends from the transverse tarsal joint to the calcaneus bone, and includes the rear and sides of the upper 12. While portrayed in the drawings as comprising three primary segments, the upper 12 may be fabricated as a single-piece construction or may be composed of any number of segments, including a toe cap, heel cap, ankle cuff, interior liner, etc. For sandal and slipper applications, the upper 12 may take on an open toe or open heel configuration, or may be replaced with a single strap or multiple interconnected straps.

The upper 12 portion of the footwear 10 may be fabricated from any one or combination of a variety of materials, such as textiles, engineered foams, polymers, natural and synthetic leathers, etc. Individual segments of the upper 12, once cut to shape and size, may be stitched, adhesively bonded, fastened, welded or otherwise joined together to form an interior void for comfortably receiving a foot. The individual material elements of the upper 12 may be selected and located with respect to the footwear 10 in order to impart desired properties of durability, air-permeability, wear-resistance, flexibility, appearance, and comfort, for example. An ankle opening 15 in the rear quarter 12C of the upper 12 provides access to the interior of the shoe 10. A shoelace 20, strap, buckle, or other conventional mechanism may be utilized to modify the girth of the upper 12 to more securely retain the foot within the interior of the shoe 10 as well as to facilitate entry and removal of the foot from the upper 12. Shoelace 20 may be threaded through a series of eyelets 16 in or attached to the upper 12; the tongue 18 may extend between the lace 20 and the interior void of the upper 12.

Sole structure 14 is rigidly secured to the upper 12 such that the sole structure 14 extends between the upper 12 and a support surface upon which stands a user. In effect, the sole structure 14 functions as an intermediate support platform that separates and protects the user's foot from the ground. In addition to attenuating ground reaction forces and providing cushioning for the foot, sole structure 14 of FIGS. 1 and 2 may provide traction, impart stability, and help to limit various foot motions, such as inadvertent foot inversion and eversion. In accordance with the illustrated example, the sole structure 14 is fabricated as a sandwich structure with a top-most insole 22, an intermediate midsole 24, and a bottom-most outsole 26. Alternative sole configurations may be fabricated with greater or fewer than three layers. Insole 22 is shown located partially within the interior void of the footwear 10, operatively attached at a lower portion of the upper 12, such that the insole 22 abuts a plantar surface of the foot. Underneath the insole 22 is a midsole 24 that incorporates one or more materials or embedded elements that enhance the comfort, performance, and/or ground-reaction-force attenuation properties of footwear 10. These elements and materials may include, individually or in any combination, a polymer foam material, such as polyurethane or ethylvinylacetate (EVA), filler materials, moderators, air-filled bladders, plates, lasting elements, or motion control members. Outsole 26 is located underneath the midsole 24, defining some or all of the bottom-most, ground-engaging portion of the footwear 10. The outsole 26 may be formed from a natural or synthetic rubber material that provides a durable and wear-resistant surface for contacting the ground. In addition, the outsole 26 may be contoured and textured to enhance the traction (i.e., friction) properties between footwear 10 and the underlying support surface.

Figure 3:
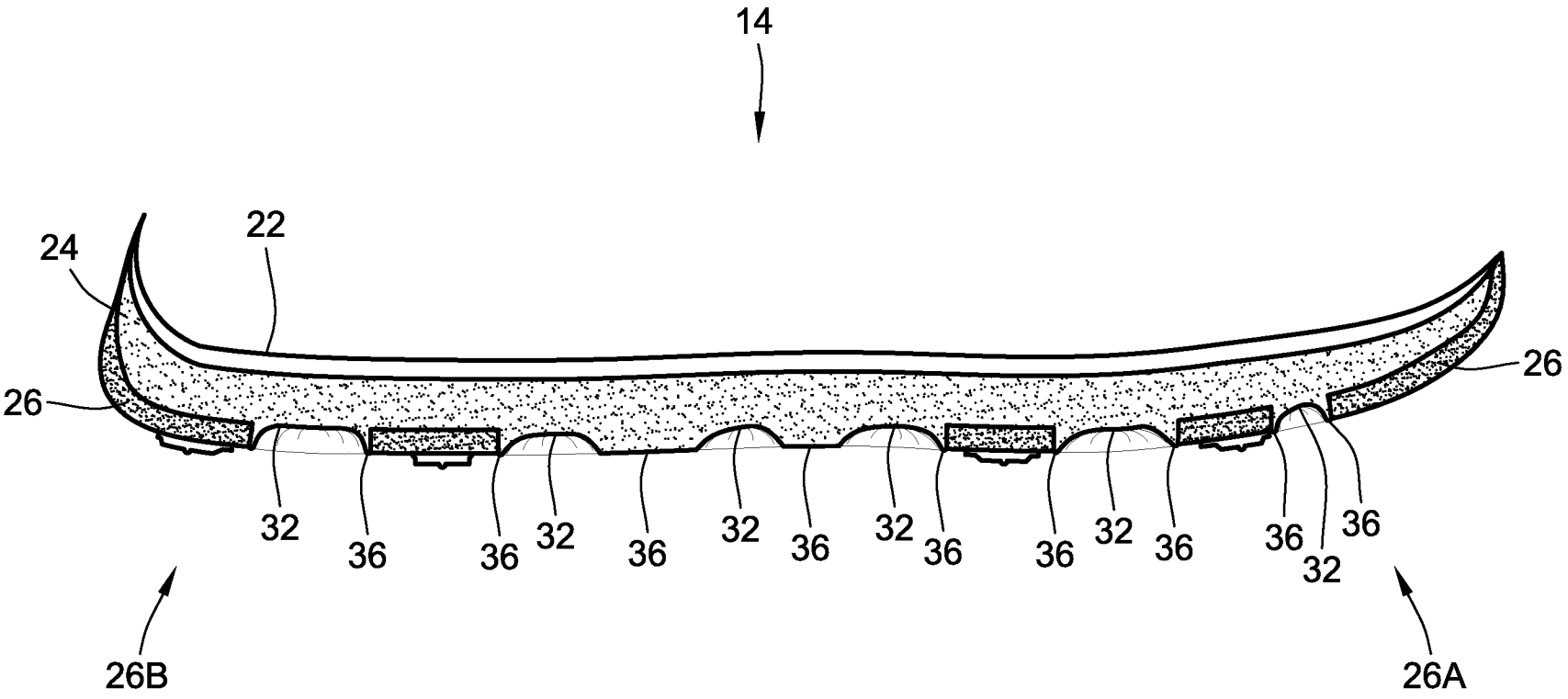
FIG. 3 is a cross-sectional, side-view illustration of the representative multilayered sole structure of FIG. 1 taken along line 3-3 of FIG. 2.

With collective reference to FIGS. 1-3, the sole structure 14 is fabricated with an impact-force-attenuating midsole 24 that is formed with a pressure-mapped topography and inlaid with a wear-mitigating outsole 26. In accord with the illustrated example, the midsole 24 is formed, in whole or in part, from a first material having a first hardness, e.g., as measured according to a suitable one of the Shore Hardness Scales or other universally-recognized methodology for gauging material rigidity. By comparison, the outsole 26 is mounted to the midsole 24, e.g., via debossing, hot pressing, fusion, adhesives, and/or push fasteners, and is formed, in whole or in part, from a distinct second material with a second hardness that is greater than the hardness of the midsole's material. It may be desirable, for at least some applications, that the Shore A hardness of the second material be larger than the Shore A hardness of the first material by at least about 20%. As a non-limiting example, the first material may include a thermoplastic polyurethane (TPU) having a material hardness in the range of about 40 to about 60 Shore A; the second material may include a synthetic rubber material having a material hardness of about 75 to about 90 Shore A. In a specific implementation, the midsole is formed via compression molding as a one-piece, unitary structure from a polymer foam, such as an ethylene-vinyl acetate (EVA) copolymer plastic or a TPU elastomer, having a density of about 0.15 to about 0.25 g/cm$^3$. In this example, the outsole 26 is formed via extrusion and stamping as a bipartite structure from a synthetic rubber, such as ethylene propylene rubber (EPR), styrene isoprene styrene (SIS) copolymer rubber, styrene butadiene rubber.

To enhance underfoot comfort for a variety of discrete gate movements during use of the footwear 10, while concomitantly enhancing ground-reaction-force attenuation, increasing energy return, and minimizing shoe weight, the midsole's topography is provided with an engineered pattern of channels and cavities, the shapes, depths, locations, orientations and mean densities of which are designed to coincide with pressure zones identified through sensor-generated pressure map data. A normative population of individuals were provided with athletic shoes retrofit with a distributed array of sensors in the sock liner. These individuals underwent pressure-map testing throughout a full day of use to chart the points along the plantar region of the foot that experience the largest and smallest magnitudes of pressure from walking, running, frequent lateral maneuvers, and the like. The aforementioned topology parameters of the midsole were then derived through algebraic tiles applied to the resultant pressure map data to create a patterned midsole that allocates polymer foam density according to pressure magnitude distribution.

Outwardly facing surfaces of the midsole 24, including the laterally and rearwardly-facing surfaces of the midsole sidewall 28 and the ground-facing surface of the midsole base 30, are formed with an assortment of recessed cavities 32 intermixed with an assortment of open channels 34. Separating the cavities 32 and the channels 34 are ground-contacting land segments 36 of varying shape, size and orientation that are coterminous with the cavities 32 and channels 34. The cavities 32 are mapped to predetermined sections of sole structure 14 that coincide with reduced-magnitude pressure zones of the user's plantar region. To do so, however, may require each cavity 32 have a distinct shape from every other cavity 32. In the same vein, the channels 34 are mapped to predetermined sections of sole structure 14 that coincide with increased-magnitude pressure zones of the plantar region; this necessitates each channel 34 have a distinct shape from every other channel 34. As a result of the distinctly shaped cavities 32 and channels 34, each land segment 36 may have a distinct shape from every other land segment 36. For at least some implementations, the outsole 26 substantially fills the midsole channels 34; in so doing, segments of the outsole 26 will share the shape and dimensions of the corresponding midsole channel 34 in which they fill. The nuanced geometries of the midsole's surface features and the outsole's channel-filling elements will be described in further detail hereinbelow.

In accord with the illustrated example, the midsole 24 may include one or more continuous chains of elongated channel segments. As seen in FIG. 2, for example, the midsole base 30 is formed with an irregular-shaped forefoot channel series 34A that is located in the forefoot region $R_{FF}$ of the sole structure 14, and an irregular-shaped hindfoot channel series 34B that is located in the hindfoot region $R_{HF}$ of the sole structure 14. The hindfoot channel series 34B has a cloud-like shape defined by an ovate central basin segment 38 with multiple round-edged plume segments 40 (nine in the illustrated example) projecting outwardly from the central basin segment 38. In contrast, the forefoot channel series 34A has multiple mutually parallel, elongated channel segments 42 (six in the illustrated example) that are interconnected by multiple linking channel segments 44 extending between the parallel channel segments 42. The midsole 24 has a longitudinal centerline $CL_1$ that extends lengthwise through the sole structure's forefoot, midfoot and hindfoot regions $R_{FF}$, $R_{MF}$, $R_{HF}$, e.g., parallel to the sagittal plane and perpendicular to the corona plane of the body. The plume segments 40 of the hindfoot channel series 34B and the parallel channel segments 42 and linking channel segments 44 of the forefoot channel series 34A are all obliquely angled with respect to the sole structure's longitudinal centerline $CL_1$. For instance, two or more of the parallel channel segments 42 may extend from the medial side $S_{ME}$ of the sole structure 14, proximate a hallux ("big") toe region of the footwear 10, to the lateral side $S_{LA}$ of the sole structure 14, proximate a minimus ("little") toe region.

It is desirable, for at least some configurations, to allocate the largest concentrations of the midsole 24 and outsole 26 at regions of the sole structure 14 that have been determined to coincide with increased-magnitude pressure zones of the plantar region, while contemporaneously minimizing or eliminating the respective volumes of midsole 24 and outsole 26 at regions of the sole structure 14 that have been determined to coincide with decreased-magnitude pressure zones of the plantar region. In order to realize this structural configuration, each segment of the midsole's discrete channel series 34A, 34B may have a distinct shape, orientation and set of dimensions. Each plume segment 40 of the hindfoot channel series 34B of FIG. 2, for example, is shown having a respective length and plan-view profile that are distinct from the lengths and profiles of all other plume segments 40. Likewise, each parallel channel segment 42 of the forefoot channel series 34A is shown having a distinct length and a distinct plan-view profile. The distinct channel segment lengths are represented in FIG. 2 by the different lengths of the dashed lines superimposed over the plume segments 40 and the channel segments 42. As opposed to a polygonal profile bounded by straight edges, the plan-view profile of each parallel channel segment 42 is defined by curved and undulating borders, having a width that varies along the length of that channel segment 42.

Figure 4:
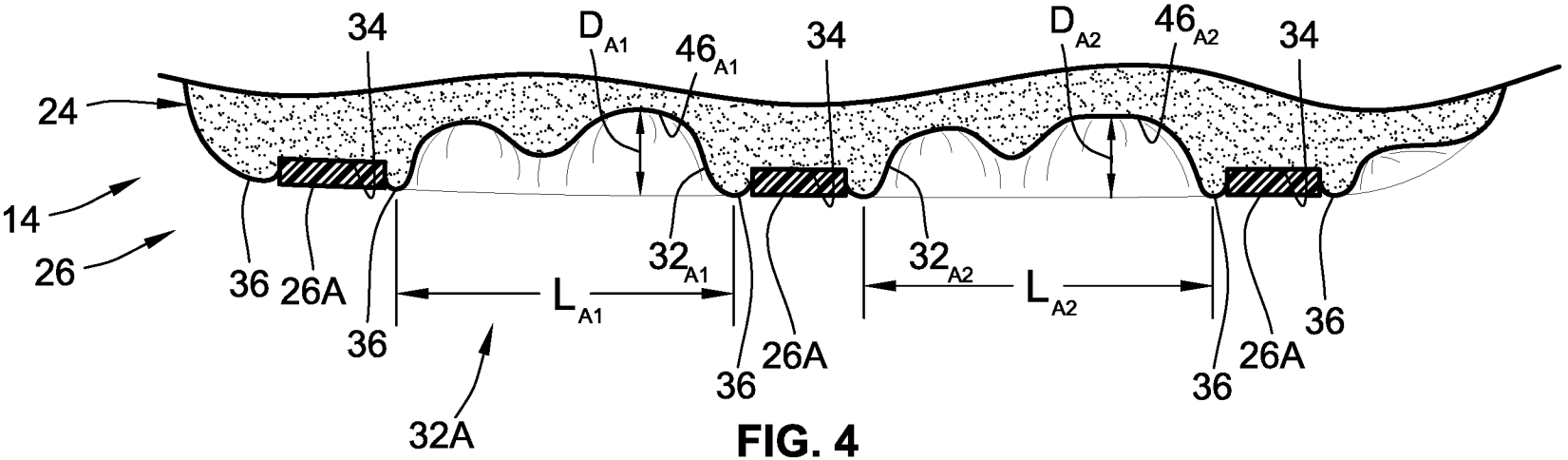
FIG. 4 is a cross-sectional, perspective-view illustration of the representative multilayered sole structure of FIG. 1 taken along line 4-4 of FIG. 2.

Similar to the geometries of the forefoot and hindfoot channel series 34A, 34B, the midsole's recessed cavities 32 may each have a respective irregular shape and corresponding set of dimensions that are distinct from the shapes and dimensions of all other cavities 32. Looking once again to FIG. 2 as a point of reference, two or more of the cavities 32 in the forefoot region $R_{FF}$ of the sole structure 14 are elongated, mutually parallel cavities interleaved with and parallel to two or more of the parallel channel segments 42 of the forefoot channel series 34A. Each parallel, elongated cavity 32 in the forefoot region $R_{FF}$ is portrayed as having a distinct length and a distinct plan-view profile. Rather than utilizing a polygonal profile bounded by straight edges, the plan-view profile of each cavity 32 is defined predominantly by arcuate and undulating borders. With this configuration, the plan-view profile of each parallel, elongated cavity 32 in the forefoot region $R_{FF}$ has a respective width that varies along the length of that cavity 32. As seen in FIG. 4, each of the cavities $\mathbf{32}_{A1}$ and $\mathbf{32}_{A2}$ has a distinct length $L_{A1}$ and $L_{A2}$, respectively, and a distinct undulating base $\mathbf{46}_{A1}$ and $\mathbf{46}_{A2}$ with a respective depth $D_{A1}$ and $D_{A2}$ that varies along the length of the cavity 32.

A further option may include varying the configurations of the cavities 32 based on their placement with respect to the sole structure 14. In accord with the representative article of footwear 10, for example, the midsole 24 is fabricated with forefoot cavities 32A located in the forefoot region $R_{FF}$ of the sole structure 14, hindfoot cavities 32B located in the hindfoot region $R_{HF}$ of the sole structure 14, and midfoot cavities 32C located in the midfoot region $R_{MF}$ of the sole structure 14. Many of the forefoot cavities 32A of FIG. 2 have a generally rectilinear orientation to complement the orientations of the parallel channel segments 42 with which they are coterminous. Conversely, many of the hindfoot cavities 32B are spaced circumferentially around the central basin segment 38 and interleaved with the plume segments 40 of the hindfoot channel series 34B. Midfoot cavities 32C, on the other hand, are erratically oriented on the ground-facing surface of the midfoot base 30; with the absence of an outsole 26 in the midfoot region $R_{MF}$, these cavities 32C effectively minimize the volume of midsole 24 in the midfoot region $R_{MF}$. While not per se required, a subset of the forefoot cavities 32A of FIG. 2 adjoin a subset of the midfoot cavities 32C, and a subset of the hindfoot cavities 32B adjoin a different subset of the midfoot cavities 32C.

As indicated above, footwear 10 employs a midsole 24 that may be formed, in whole or in part, from a polymer foam composition that provides enhanced ground-reaction force attenuation while providing a softer feel with increased energy return. Such foam compositions, however, may result in a less-than-desirable durability with diminished resistance to normal wear and tear resulting from use of the footwear 10. To help improve the overall durability and resilience of the sole structure 14 without unduly increasing materials costs and shoe weight, the wear-resistant outsole 26 if fabricated as a bipartite structure with a forefoot outsole segment 26A that is longitudinally spaced from a hindfoot outsole segment 26B, each of which is disposed in and substantially fills a respective one of the forefoot and hindfoot channel series 34A, 34B. Each segment 26A and 26B of the outsole 26 is interspersed with a respective subset of the cavities 32A, 32B such that bottom-most, ground-contacting surfaces of the outsole 26 are substantially flush with the ground-contacting land segments 36 of the midsole 24, as seen in FIG. 3. Conversely, the midfoot region $R_{MF}$ of the midsole 24 is shown without a ground-contacting outsole. In other words, the outsole 26 may be limited to the forefoot and hindfoot regions $R_{FF}$, $R_{HF}$; the outsole 26 neither covers nor mounts to the midfoot region $R_{MF}$ of the midsole 24.

By substantially filling the forefoot and hindfoot channel series 34A, 34B of the midsole 24 with the forefoot and hindfoot segments 26A, 26B of the outsole 26, respectively, the outsole segments 26A, 26B take on the shapes and dimensions of their corresponding midsole channel series 34A, 34B. For instance, the forefoot outsole segment 26B of FIG. 2 is formed with an ovate central region 48 with multiple round-edged arms 50 that generally correspond in shape, size, location and orientation with the central basin segment 38 and plume segments 40, respectively, of the hindfoot channel series 34B. In the same vein, the forefoot outsole segment 26A of FIG. 2 is formed with multiple mutually parallel, elongated sections 52 that are interconnected by multiple linking sections 54 that generally correspond in shape, size, location and orientation with the parallel channel segments 42 and linking channel segments 44, respectively, of the forefoot channel series 34A.

Figure 5:
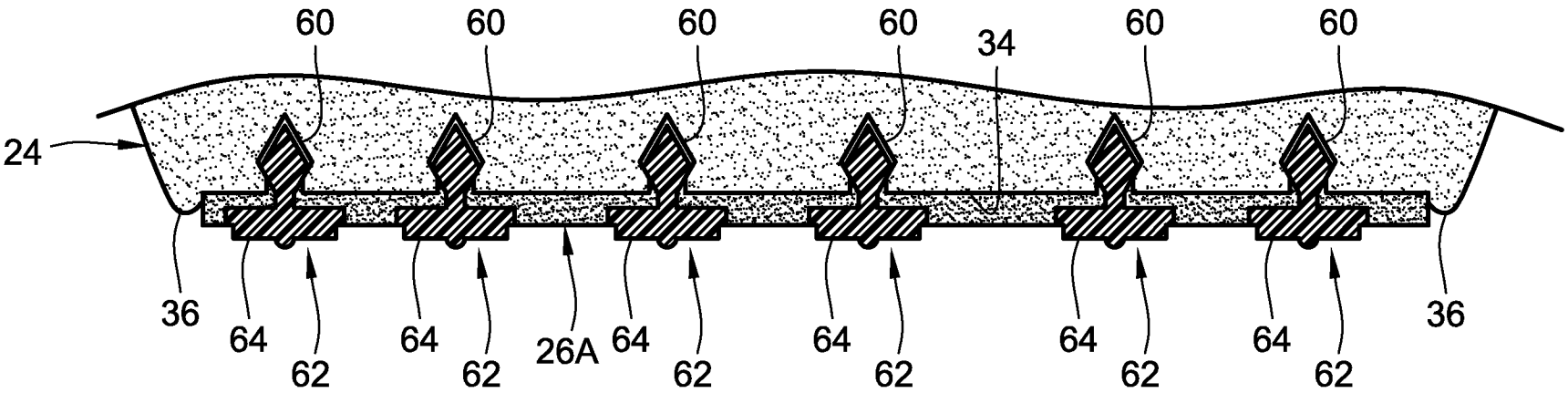
FIG. 5 is a cross-sectional, perspective-view illustration of the representative multilayered sole structure of FIG. 1 taken along line 5-5 of FIG. 2.

The sole structure 14 of FIGS. 1 and 2 may employ fasteners for mechanically attaching the outsole 26 to the midsole 24. By way of example, and not limitation, the midsole 24 may be formed with a plurality of internal pockets 60 (FIG. 5), with each pocket positioned at a high-magnitude pressure location of the sole structure 14. Rubber push fasteners 62 extend through the outsole 26, into the midsole 24, and interference fit with the pockets 60. Each fastener 62 is formed with a ground-contacting head portion 64 that protrudes from the bottom-most, ground-contacting surface of the outsole 26, as best seen in FIG. 5. A subset of the fasteners 62 may be arranged in mutually parallel rows of fasteners, each of which extends through a respective one of the parallel channel segments 44, as seen in FIG. 2. As noted above, the midsole 24 is fabricated with a sidewall 28 that defines the outer perimeter of the sole structure 14; discrete segments of the outsole 26 extend from the ground-facing surface of the midsole base 30, wrap around the edge of the base 30, and cover discrete portions of the sidewall 28, as seen in FIG. 1. Multiple fasteners 62 extend through the outsole 26, into sidewall 28, and interference fit with pockets 60 in the midsole 24.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A method of manufacturing a sole structure for an article of footwear, the method comprising:

forming, using a first material having a first hardness, a midsole having a ground-facing surface with a plurality of cavities, a plurality of channels interspersed with the cavities, and ground-contacting land segments separating the cavities from the channels, the channels including a first channel segment parallel to a second channel segment, the first channel segment having a first length and a first plan-view profile, the second channel segment having a second length and a second plan-view profile, and the first and second plan-view profiles having first and second widths, respectively, that each vary along the length of the channel segment;

forming, using a second material having a second hardness distinct from the first hardness, an outsole having a ground-contacting outsole surface; and mounting the outsole to the midsole with the outsole disposed in the channels and positioned between the cavities such that the ground-contacting outsole surface is substantially flush with the ground-contacting land segments of the midsole.

2. The method of claim 1, wherein the channels include a chain of elongated channel segments substantially parallel to each other and interconnected by multiple linking channel segments.

3. The method of claim 1, wherein the channels include first and second linking channel segments interposed between, substantially orthogonal to, and connecting the first and second channel segments.

4. The method of claim 1, wherein the channels include a plurality of elongated channel segments substantially parallel to each other and obliquely angled with respect to a longitudinal centerline extending lengthwise through the midsole.

5. The method of claim 1, wherein the first and second channel segments extend from a medial side of the sole structure to a lateral side of the sole structure.

6. The method of claim 1, wherein the first length, the first width, and the first plan-view profile of the first channel segment are distinct from the second length, the second width, and the second plan-view profile, respectively, of the second channel segment.

7. The method of claim 1, wherein the midsole has a sidewall adjoining the ground-facing surface and defining an outer perimeter of the midsole, the channels of the midsole including a plurality of sidewall channel segments extending from the ground-facing surface and onto the sidewall, and the outsole including multiple outsole segments disposed in the sidewall channel segments of the midsole.

8. The method of claim 7, further comprising a plurality of fasteners extending through the outsole segments and into the sidewall channel segments, the fasteners being interference fit with pockets in the sidewall of the midsole.

9. The method of claim 1, wherein the channels include forefoot channels located in a forefoot region and hindfoot channels located in a hindfoot region and spaced from the forefoot channels, and wherein the outsole includes discrete forefoot and hindfoot outsole segments disposed in the forefoot and hindfoot channels, respectively, of the midsole.

10. The method of claim 9, wherein the cavities include midfoot cavities located in a midfoot region of the midsole between the forefoot and hindfoot regions, the midfoot region of the midsole being characterized by a lack of a ground-contacting outsole.

11. The method of claim 10, wherein the cavities include discrete forefoot and hindfoot cavities located in the forefoot and hindfoot regions, respectively, of the midsole and exposed through the forefoot and hindfoot outsole segments, respectively.

12. The method of claim 1, wherein the cavities include a first elongated cavity having a first undulating base with a first depth that varies along a first length of the first elongated cavity, and a second elongated cavity having a second undulating base with a second depth that varies along a second length of the second elongated cavity.

13. The method of claim 1, wherein the midsole is molded as a single-piece structure from a polymer foam, and wherein the outsole is molded as a bipartite structure from a synthetic rubber.

14. The method of claim 1, wherein the midsole is formed entirely from the first material, the outsole is formed entirely from the second material, and the second hardness of the second material is greater than the first hardness of the first material.

15. A method of manufacturing a sole structure for an article of footwear, the method comprising:

forming, using a first material having a first hardness, a midsole having a ground-facing surface with a plurality of cavities, a plurality of channels interspersed with the cavities, and ground-contacting land segments separating the cavities from the channels, the cavities including a plurality of mutually parallel elongated cavities, each of the elongated cavities having a length and a plan-view profile, wherein the plan-view profile of each of the elongated cavities has a respective width that varies along the length of the elongated cavity;

forming, using a second material having a second hardness distinct from the first hardness, an outsole having a ground-contacting outsole surface; and mounting the outsole to the midsole with the outsole disposed in the channels and positioned between the cavities such that the ground-contacting outsole surface is substantially flush with the ground-contacting land segments of the midsole.

16. A method of manufacturing a sole structure for an article of footwear, the method comprising:

forming, using a first material having a first hardness, a midsole having a ground-facing surface with a plurality of cavities, a plurality of channels interspersed with the cavities, and ground-contacting land segments separating the cavities from the channels, the cavities including a plurality of mutually parallel elongated cavities, each of the elongated cavities having a respective length, a respective plan-view profile, and a respective undulating base with a depth that varies along the length of the elongated cavity;

forming, using a second material having a second hardness distinct from the first hardness, an outsole having a ground-contacting outsole surface; and mounting the outsole to the midsole with the outsole disposed in the channels and positioned between the cavities such that the ground-contacting outsole surface is substantially flush with the ground-contacting land segments of the midsole.

17. The method of claim 16, wherein the channels include a chain of elongated channel segments substantially parallel to each other and interconnected by multiple linking channel segments.

18. The method of claim 16, wherein the channels include a plurality of elongated channel segments substantially parallel to each other and obliquely angled with respect to a longitudinal centerline extending lengthwise through the midsole.

19. The method of claim 16, wherein the channels include forefoot channels located in a forefoot region and hindfoot channels located in a hindfoot region and spaced from the forefoot channels, and wherein the outsole includes discrete forefoot and hindfoot outsole segments disposed in the forefoot and hindfoot channels, respectively, of the midsole.

20. The method of claim 19, wherein the cavities include midfoot cavities located in a midfoot region of the midsole between the forefoot and hindfoot regions, the midfoot region of the midsole being characterized by a lack of a ground-contacting outsole.

* * * * *